US006659298B2

(12) United States Patent
Wong

(10) Patent No.: US 6,659,298 B2
(45) Date of Patent: Dec. 9, 2003

(54) POLYESTER BEER BOTTLE

(76) Inventor: Chio Fai Wong, No. 1 Land Area, ZhuHai Free Trade Zone, ZhuHai, GuangDong Province (CN), 519070

( * ) Notice: Subject to any disclaimer, the term of this patent is extended or adjusted under 35 U.S.C. 154(b) by 0 days.

(21) Appl. No.: 10/119,374

(22) Filed: Apr. 9, 2002

(65) Prior Publication Data

US 2003/0042221 A1 Mar. 6, 2003

(30) Foreign Application Priority Data

Sep. 3, 2001 (CN) ..... 01255517 U
Dec. 4, 2001 (CN) ..... 01276296 U

(51) Int. Cl.[7] ..... B65D 1/02; B65D 23/00

(52) U.S. Cl. ..... 215/373; 215/371; 220/606; 220/609

(58) Field of Search ..... 220/606, 609, 220/608; 215/370, 371, 373, 374

(56) References Cited

U.S. PATENT DOCUMENTS 3,511,401 A * 5/1970 Lachner ..... 215/373
3,720,339 A * 3/1973 Khetani ..... 215/373
4,231,483 A * 11/1980 Dechenne et al. ..... 220/608
4,412,627 A * 11/1983 Houghton et al. ..... 220/609
4,465,199 A * 8/1984 Aoki ..... 215/373
4,755,404 A * 7/1988 Collette ..... 215/373 X
4,894,268 A * 1/1990 Greenwood et al. .... 215/373 X
5,072,841 A * 12/1991 Okhai ..... 220/606 X
5,198,248 A * 3/1993 Krishnakumar et al. 220/606 X
5,236,097 A * 8/1993 Behm et al. ..... 215/373
6,299,007 B1 * 10/2001 Takeuchi ..... 215/373

FOREIGN PATENT DOCUMENTS

| | | | |
|---|---|---|---|
| CN | 97198151.5 | 9/1997 | |
| DE | 2713879 | * 10/1977 | ..... 215/382 |
| EP | WO 9812127 | 3/1998 | |
| EP | 947429 | * 10/1999 | |
| EP | 957030 | * 11/1999 | |

* cited by examiner

*Primary Examiner*—Sue A. Weaver

(57) ABSTRACT

A polyester beer bottle comprising a bottleneck, a body and a bottom of the bottle, which are once blown and shaped with polyester blank, in which arc portion in a vertical section extended from the joint of shaped bottom and body of the bottle to a plane of the bottom has a radius ranging over 15–25 mm; an arc radius in a vertical section of the concave quaquversal portion projecting inwards at a bottom surface of said bottle is in a range of 20–35 mm, and the distance between a top of the concave quaquversal portion to the plane of bottom is in a range of 7–15 mm; an outward projecting support flange portion is formed at the joint between said concave quaquversal portion and the bottom plane of the bottle, a height of the flange portion is in a range of 0.1–5 mm; and a side-face of the bottle is connected to said concave quaquversal portion at the bottom of the bottle via the transition arc portions respectively having different radius, in which the radius of first transition arc is in a range of 3–8 mm, and the second transition arc radius is in a range of 0.5–2 mm. The ratio between the maximum outer diameter of the bottom of the bottle and the diameter of the flange portion on said bottom plane of the bottle is in a range of 1.2–1.7.

10 Claims, 2 Drawing Sheets

A–A

POLYESTER BEER BOTTLE

CROSS REFERENCE TO RELATED APPLICATION

This application claims the priority benefit of Chinese Application Serial No. 01255517.7 filed Sep. 3, 2001, and Chinese Application Serial No. 01276396.2 filed Dec. 4, 2001.

BACKGROUND OF THE INVENTION

1. Technical Field

The invention relates to a container to accept liquid, more specifically, to a beer bottle made of a plastic material of one type of polyester (e.g. PET-polyethylene terephthalate).

2. Background Art

Currently used beer bottles are mostly glass bottles, due to their fragility, even a matter damaging human by the glass fragments or granules accidentally occurs while natural explosion of glass beer bottles seldom occurred, people thus switch over to using plastic bottles for containing beer. For example, a laminated plastic vessel has been disclosed in a patent application publication of China No. 971981515.5 titled "Zero Oxygen Seepage Plastic Bottle for Beer and Other Use". This is a laminated plastic vessel for containing beer, fruit juice, and flavouring etc, in which a layer comprising oxygen scavenger is involved. The structure and manufacturing engineering of this plastic beer bottle are both complicated. A specially assigned oligomer polyester chain segment formulation should be required, thus the fabrication cost cannot be lowered.

On the other hand, in current plastic beer bottle, the neck portion of bottle easily occurs a distortion when it is heated, and then it results in a kickback for hermeticity, due to the reason of its bottle-neck and bottom structure, such as the neck portion of bottle has not a heat-resistant ability. In addition, the diameter of bottle body is the same as that of the bottle bottom and any configuration opposing distortion does not provide at the bottom, so that the overall supporting hardness of the bottom of a plastic beer bottle is weaker than that of the glass bottle, therefore deformation is easily occurred, particularly in a case of the sterilization at high-temperature, the overall shape of the bottle can be hardly maintained. A phenomenon for a deformation of the bottle-neck portion and a unstable erecting of the body by said outwards protruding often occurs. All these aspects directly affect their spreading and application on market.

BRIEF DESCRIPTION OF THE INVENTION

An object of the invention is to provide a polyester beer bottle having a simple structure, good overall supporting hardness and strength, resisting to the deformation as well as having a lower cost for manufacture.

To carry out above object, the invention provides a polyester beer bottle comprising a bottleneck portion, a body portion and a bottom portion of the bottle, which are once blown and shaped with polyester blank, in which an arc portion in a vertical section extended from the joint of shaped bottom and body of the bottle to a horizontal face in being the bottom has a radius ranging over 15–25 mm; a bottom surface of said bottle forms a concave quaquaversal portion projecting inwards, an arc radius in a vertical section of the concave quaquaversal portion is in a range of 20–35 mm, and the distance between a top of the concave quaquaversal portion to the plane of bottom face is in a range of 7–15 mm; an outward projecting support flange portion is formed at the joint between said concave quaquaversal portion and the bottom plane of the bottle, a height of the flange portion is in a range of 0.1–5 mm; a side-face of the bottle is connected to said concave quaquaversal portion at the bottom of the bottle via the transition arc portions respectively having different radius.

Preferably, a first transition arc radius can be in a range of 3–8 mm, and a second transition arc radius can be in a range of 0.5–2 mm. The ratio between the maximum outer diameter of the bottom portion of the bottle and the diameter of the flange portion on said bottom plane of the bottle is in a range of 1.2–1.7.

With the polyester beer bottle having above structure of the invention, by means of the multiple structural measures, particularly its unique bottom structure, the polyester beer bottle can not only be non-deformable in utilization, but also be non-explosive and non-penetrable, even a sterilization processing at high-temperature such as 70° C. (Pasteurize) is experienced in the bottle, it can still maintain the overall shape of the bottle structure in invariant and steadily arises. As a result of an actual testing, after a sterilization processing at high-temperature, a rate of the deformation for the bottle is not more 3%. Consequently, the polyester beer bottle of the invention may be extensively used in filling and marketing of the beer and beverages.

The structure, features and advantages of polyester beer bottle of the invention will become apparent from the following detailed description for a preferred embodiment incorporating with the accompanying drawings.

DETAILED DESCRIPTION OF PREFERRED EMBODIMENT

Figure 1:
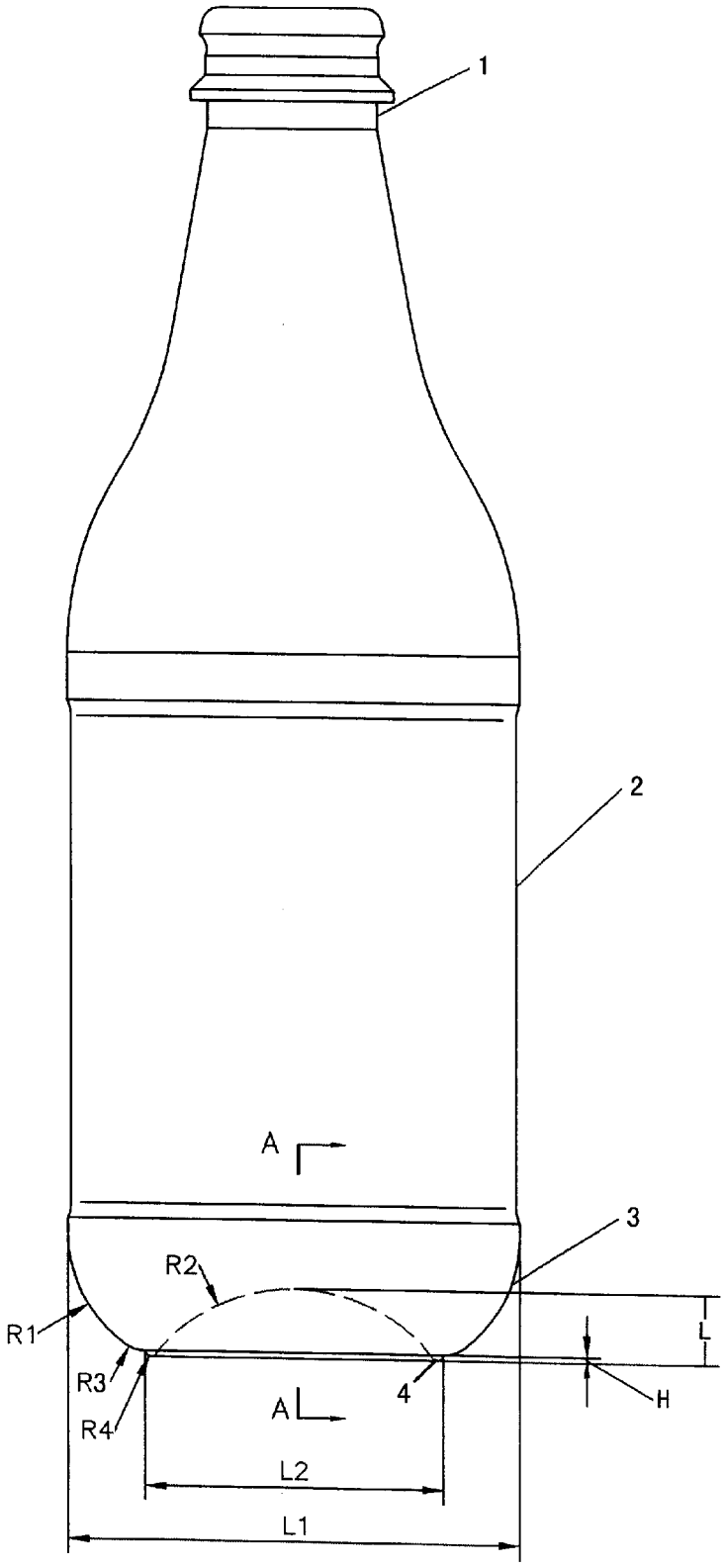
FIG. 1 is a plan view showing a polyester beer bottle structure in a preferred embodiment of the invention.
Figure 2:
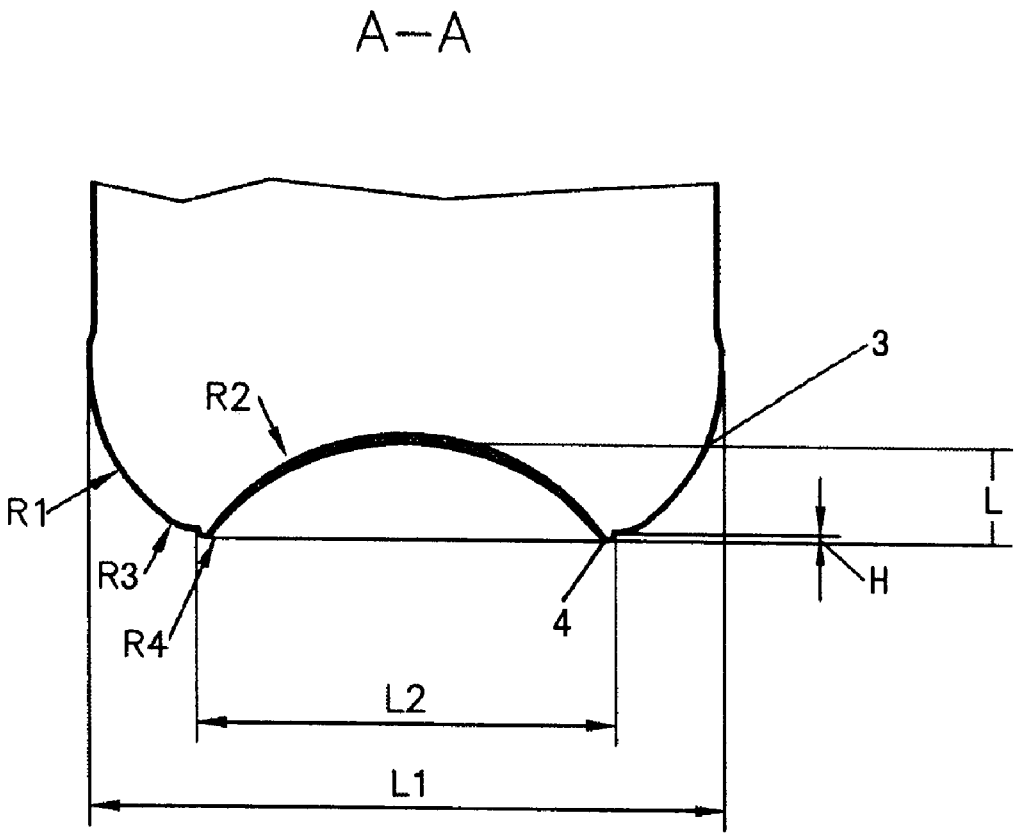
FIG. 2 is a section view taken in A—A line in FIG. 1.

As shown in FIG. 1, a polyester beer bottle of an embodiment of the invention comprises: a bottleneck 1, a body of the bottle 2 and a bottom of the bottle 3, (hereinafter, the body of the bottle and the bottom of the bottle will be stated respectively in brief for a body and a bottom), in which said bottleneck 1, body 2 and bottom 3 are made by means of once blowing and shaping a bottle blank made of polyethylene terephthalate (PET) material. It can be seen from the diagram that a vertical section extending from the joint of bottom 3 and body 2 to a horizontal face of said bottom 3 forms an arc section, and the radius R1 of said arc section is in a range of 15–25 mm. A vertical section of said bottom 3 forms a concave quaquaversal portion projecting inwards and the radius R2 of the concave quaquaversal portion is in a range of 20–35 mm. In addition, the distance L between a top of the concave quaquaversal portion to a plane of said bottom 3 is in a range of 7–15 mm. An outwards protruding flange portion 4 is formed by an edge of said concave quaquaversal portion at a plane of the bottom of the bottle. The height of the flange portion 4 is in a range of 0.1–5 mm. A side-face of the bottle is connected to said concave quaquaversal portion at the bottom of the bottle via the transition arc portions respectively having different radius R3 and R4, in which the radius R3 of a first transition arc can be in a range of 3-mm and the radius R4 of a second transition arc can be in a range of 0.5–2 mm.

According to the polyester beer bottle of the embodiment, the ratio between the maximum outer diameter of the bottom 3 and the diameter of the flange portion 4 on said plane of the bottom of the bottle is in the range of 1.2–1.7.

More specifically, as an embodiment, it can also be seen from FIG. 1, the radius R1 of the arc of said vertical section extending from the joint of bottom 3 and body 2 to the joint of the plane on the bottom face of PET beer bottle is 25 mm. In the inward projected concave quaquaversal portion formed in the bottom portion 3, a radius R2 of the concave quaquaversal portion is 27.5 mm, and a distance L from the top of the concave quaquaversal portion to the plane of the flange portion 4 is 9 mm.

In addition, a height H of the flange portion 4 for the concave quaquaversal portion on the plane of said bottom 3 is 1.6 mm.

Moreover, as an embodiment, the arc portion of the vertical section of PET beer bottle has a radius R1 at the joint between the bottom 3 and the concave quaquaversal portion, and said arc portion connected by the transition arcs having radii R3 and R4 respectively, in which the radius R3 of the first transition arc is 8 mm, and the radius R4 of the second transition arc is 2 mm.

In the PET beer bottle of this embodiment, the ratio between the maximum outer diameter L1 of said bottom 3 and the diameter L2 of the flange portion 4 on the plane of said bottom 3 is 1.5.

What is the claims:

1. A polyester bottle comprising a bottleneck, a body and a bottom of the bottle, which are blown and shaped from a polyester blank, wherein said bottom has a lower portion and an arc portion in a vertical section extended between the body of the bottle to the lower portion of the bottom, said arc portion having a radius ranging over 15–25 mm;

said bottom of said bottle having a concave quaquaversal portion projecting inwards, an arc radius in a vertical section of the concave quaquaversal portion is in a range of 20–35 mm, and the distance between a top of the concave quaquaversal portion of the lower portion of the bottom is in a range of 7–15 mm;

a downwardly projecting support flange portion is formed at the joint between said concave quaquaversal portion and the lower portion of the bottom of the bottle, the flange portion has a height in a range of 0.1–5 mm; and said flange portion having transition arc portions respectively having different radius.

2. The polyester bottle according to claim 1, wherein said transition arc portions comprise a first transition arc having a radius in a range of 3–8 mm, and a second transition arc having a radius in a range of 0.5–2 mm.

3. The polyester bottle according to claim 1, wherein the bottom has a maximum outer diameter and the flange portion has a diameter, the ratio between the maximum outer diameter of the bottom of the bottle and the diameter of the flange portion is in a range of 1.2–1.7.

4. The polyester bottle according to claim 1, wherein, the flange portion is a circular flange.

5. A polyester bottle comprising a bottleneck, a body and a bottom of the bottle, which are blown and shaped from a polyester blank, wherein said bottom has a lower portion, and an arc portion in a vertical section extended between the body of the bottle and the lower portion of the bottom, said arc portion having a radius, said radius of the arc portion of said vertical section is 25 mm; a said bottom of said bottle having a concave quaquaversal portion projecting inwards, an arc radius in a vertical section of the concave quaquaversal portion is 27.5 mm, the distance between a top of the concave quaquaversal portion and the lower portion of the bottom is in a range of 7–15 mm, and a downwardly projecting support flange portion located at the joint between said concave quaquaversal portion and the lower portion of the bottom of the bottle, the flange portion having a height in a range of 0.1–5 mm, said flange portion having transition arc portions respectively having different radius.

6. The polyester bottle according to claim 5, wherein the bottom has a maximum outer diameter and the flange portion has a diameter, the ratio between the maximum outer diameter of said bottom and the diameter of the flange portion is 1.5.

7. The polyester bottle according to claim 6, wherein, one of the transition arc portions has a radius of 8 mm.

8. The polyester bottle according to claim 6, wherein, the height of the flange portion is 1.6 mm.

9. The polyester bottle according to claim 6, wherein, the flange portion is a circular flange.

10. The polyester bottle according to claim 5, wherein said transition arc portions comprise a first transition arc having a radius in a range of 3–8 mm, and a second transition arc having a radius in a range of 0.5–2 mm.

* * * * *